US005569062A

United States Patent [19]

Karlsrud

[11] Patent Number: 5,569,062

[45] Date of Patent: Oct. 29, 1996

[54] POLISHING PAD CONDITIONING

[75] Inventor: Chris Karlsrud, Chandler, Ariz.

[73] Assignee: Speedfam Corporation, Des Plaines, Ill.

[21] Appl. No.: 497,530

[22] Filed: Jul. 3, 1995

[51] Int. Cl.[6] ..... B24B 5/00

[52] U.S. Cl. ..... 451/285; 451/56

[58] Field of Search ..... 451/56, 41, 285, 451/287, 288, 283, 443, 444, 72

[56] References Cited

U.S. PATENT DOCUMENTS

| | | | |
|---|---|---|---|
| 5,081,795 | 1/1992 | Tanaka et al. | 451/285 |
| 5,119,599 | 6/1992 | Klipper et al. | 451/56 |
| 5,216,843 | 6/1993 | Breivogel et al. | 51/131.1 |
| 5,411,431 | 5/1995 | Basstein et al. | 451/56 |
| 5,433,650 | 7/1995 | Winebarger | 451/287 |
| 5,456,627 | 10/1995 | Jackson et al. | 451/56 |
| 5,486,131 | 1/1996 | Cesna et al. | 451/56 |

*Primary Examiner*—D. S. Meislin
*Assistant Examiner*—Andrew Weinberg
*Attorney, Agent, or Firm*—Fitch, Even, Tabin & Flannery

[57] ABSTRACT

A rotating polishing wheel having secured to its top surface a polishing pad and a vertically movable carrier element for carrying a workpiece to be polished into contact with the polishing pad and exerting a desired pressure on the workpiece. Operatively attached to the carrier is a conditioning element movable with the carrier and having on its bottom surface cutting means disposed in a circular configuration for conditioning the polishing pad by contact therewith.

10 Claims, 1 Drawing Sheet

POLISHING PAD CONDITIONING

This invention relates to polishing of thin work-pieces such as silicon wafers used in semiconductors.

1. Background of the Invention

In machining processes such as polishing or planarization of thin workpieces, such as silicon substrates or wafers used in integrated circuits, a wafer is disposed between a carrier or pressure plate and a rotatable polishing table carrying on its surface a polishing pad. The pressure plate applies pressure so as to effect removal of rough spots from the wafer and to produce a surface of substantially uniform thickness on the wafer.

Generally, the polishing apparatus includes a rigid pressure plate or carrier to which unpolished wafers are adhered, with the wafer surfaces to be polished exposed to a polishing pad which engages the same with polishing pressure. The polishing pad and carrier are then typically both rotated at differential velocities to cause relative lateral motion between the polishing pad and the wafer front side surfaces. An abrasive slurry, such as a colloidal silica slurry, is generally provided at the polishing pad-wafer surface interface during the polishing operation to aid in the polishing.

The preferred type of machine with which the present invention is used includes a rotating polishing wheel which is rotatably driven about a vertical axis. Typically, the polishing wheel comprises a horizontal ceramic or metallic platen. The polishing pads can be formed of various materials, as is known in the art, and which are available commercially. Typically, the polishing pad is a blown polyurethane, such as the IC and GS series of polishing pads available from Rodel Products Corporation of Scottsdale, Ariz. The hardness and density of the polishing pad is routinely selected based on the type of material that is to be polished. The polishing pad is rotated about a vertical axis and has an annular polishing surface on which the work pieces are placed in confined positions so that movement of the polishing wheel and the superimposed attached polishing pad relative to the work pieces brings about abrasive wear of the latter at their surfaces in engagement with said polishing surface. Of importance in all such machines is the maintenance of the polishing pad surface in planar condition and substantially free of surface irregularities. The polishing pads tend to wear unevenly in the polishing operation and surface irregularities develop therein, and these problems must be corrected.

2. Objects of the Invention

It is therefore a principal object of this invention to provide for conditioning of polishing pads to remove surface irregularities and achieve a planar pad condition.

It is another object of this invention to provide an apparatus for conditioning of polishing pads during a polishing operation to remove surface irregularities and achieve a planar pad condition.

It is another object of this invention to minimize the need for a separate aggressive pad conditioning after each polishing operation.

A further object of the invention is to provide for better management of the polishing pad surface profile and roughness by achieving high polishing removal rates and improved removal uniformity across the surface of the wafer.

A further object of the invention is to minimize any surface trench which normally forms due to polishing.

A further object of the invention is to achieve practical benefits when longer polishing times are utilized.

A still further object of the invention is to provide consistency from polishing run to run due to the minimization of pad damage which occurs during polishing.

SUMMARY OF THE INVENTION

The present invention is directed to conditioning a polishing pad so as to manage the surface profile and roughness of the pad while the pad is performing a polishing operation. This is accomplished according to the present invention by use of a circular conditioning element having on its lower surface cutting means which contacts and abrades the polishing pad under pressure while the pad is accomplishing polishing of a substrate. The conditioning element is attached to the wafer carrier pressure plate and rotates therewith. The conditioning element extends below the bottom surface of the carrier and has a downwardly extending leg portion with its terminus having cutting means thereon. When the wafer carrier is applying pressure to cause the wafer to contact the pad for polishing the cutting means of the circular conditioning element also contacts the pad and conditions it simultaneously with the polishing operation.

Thus, according to the present invention a substrate to be polished is brought under pressure into contact with a rotating polishing wheel having on its upper surface a polishing pad so as to effect polishing of the substrate. While polishing the substrate, the polishing pad is also contacted with a conditioning element having cutting means thereon which contact and condition the pad. Usually, and preferably, an abrasive slurry is applied between the polishing pad and substrate to achieve enhanced polishing.

The present invention involves, in combination, a rotating polishing wheel having secured to its top surface a polishing pad and a vertically movable carrier element for carrying a workpiece to be polished into contact with the polishing pad and exerting a desired pressure on the workpiece. Operatively attached to the carrier is a conditioning element movable with the carrier and having on its bottom surface cutting means disposed in a circular configuration for conditioning the polishing pad by contact therewith.

DESCRIPTION OF THE PREFERRED EMBODIMENTS

Figure 1:
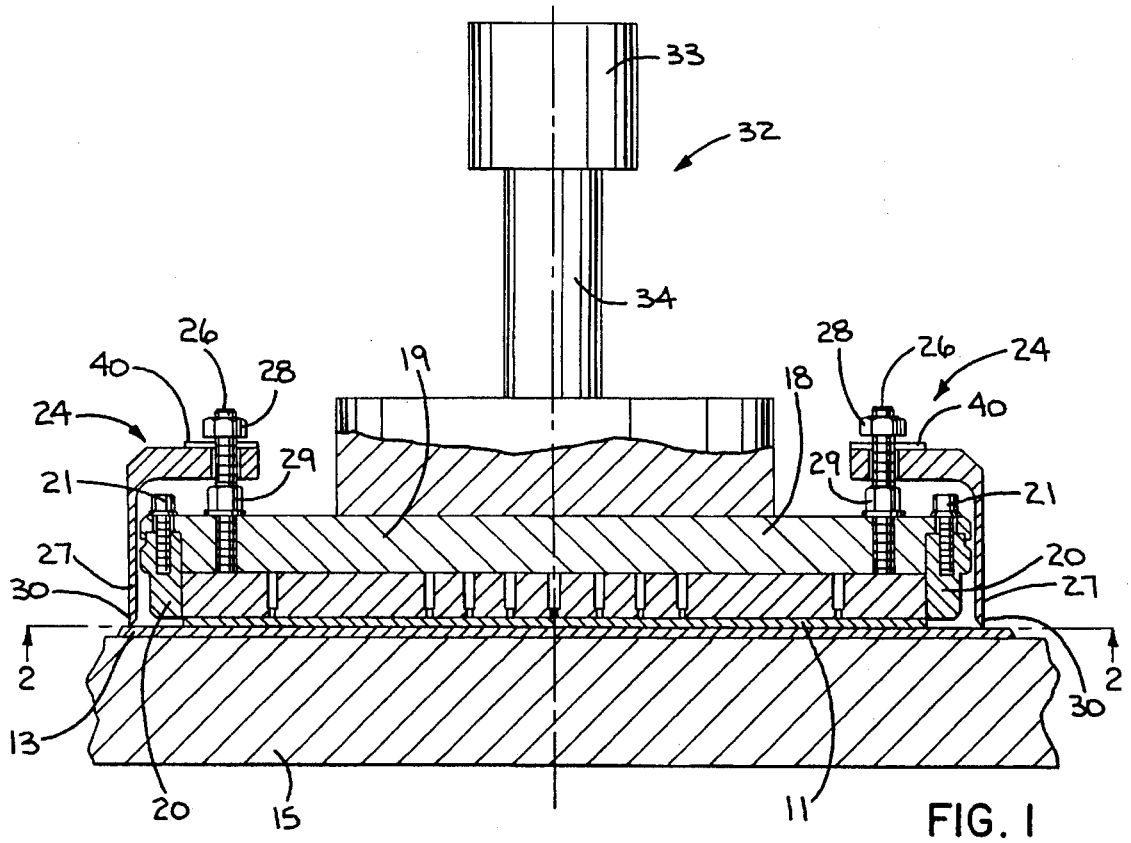
FIG. 1 is a schematic side view of typical apparatus for polishing thin workpieces, such as semiconductor wafers and including the integral pad conditioning means of this invention.

FIG. 1 illustrates one preferred form of conditioning element according to this invention. During polishing the substrate 11 to be polished, such as a silicon wafer, is placed face down to abut polishing pad 13 which is fixedly attached to the upper surface of rotatable polishing wheel 15.

A metal or ceramic carrier 18 is used to apply a downward pressure against the backside of substrate 11. Substrate 11 is held by carrier 18 by various means known in the art, such as, for example, by vacuum or by wet surface tension. A protective layer 19 of urethane or the like is attached to pressure plate 18 to protect the surface of the wafer or substrate being polished. A circular retaining ring 20 is secured to carrier 18 by bolts 21 to prevent the wafer from slipping laterally from beneath carrier 18 during polishing. Also attached to carrier 18 is pad conditioning element 24 which is a ring formed of a rigid material, such as metal, having an inverted L configuration. As shown in FIG. 1, the downwardly extending leg 27 of conditioning element 24 terminates in a sharp cutting tip 30, say at an angle of about 45°. The cutting tip can be hardened for extended life, or provided with a diamond cutting edge, for example. Leg 27 is of sufficient length so that the cutting element 30 contacts the polishing pad. Bolts 26 loosely secure the conditioning element 24 to carrier 18 so as to permit limited vertical movement but not lateral movement of conditioning element 24. Slight vertical movement of conditioning element 24 between spaced nuts 28 and 29 is permitted so that cutting point 30 contacts pad 13 by virtue of its own weight. Additional weighted rings 40 can be added to conditioning element 24 to increase weight and conditioning capability.

Figure 2:
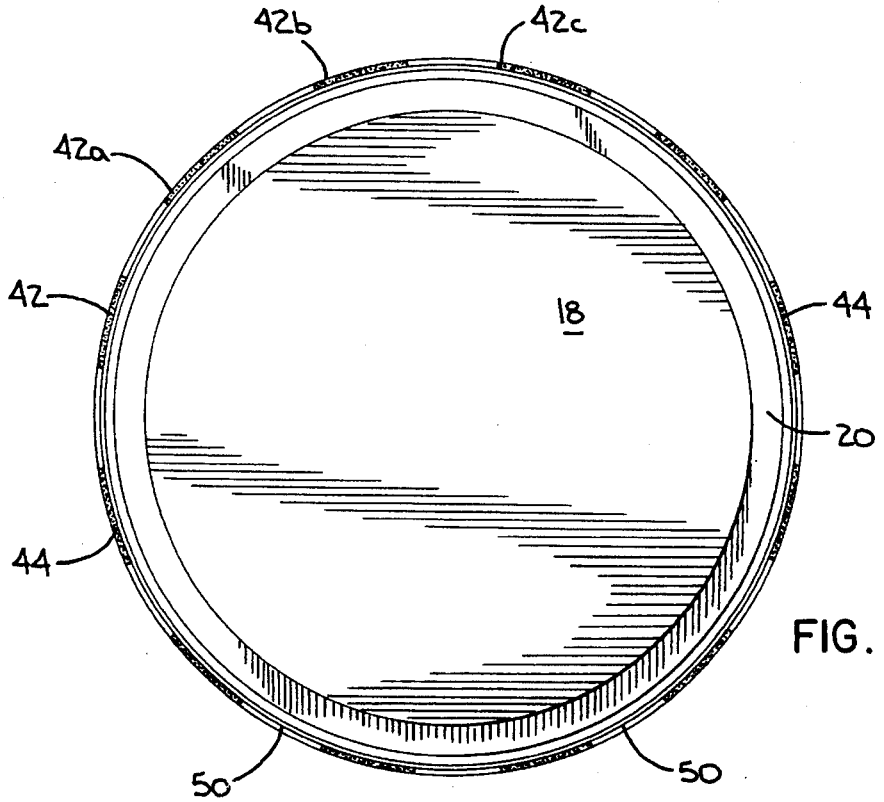
FIG. 2 is a schematic bottom plan view of the typical polishing apparatus including the pad conditioning means of this invention.

Alternatively, the downwardly extending leg 27, as shown in FIG. 2, can have a flat bottom surface 42 which is interrupted to form a plurality of circular segments 42*a*, 42*b*, 42*c* and so forth carrying a hard cutting material which presents a sharp cutting face to the polishing pad so as to accomplish conditioning, i.e., truing and dressing of the polishing pad. Representative of said hard cutting materials 44 are diamond particles or grits, polycrystalline chips-slivers, cubic boron nitrite particles, silicon carbide particles and saw blades such as band saw blades with the regular alternate type, i.e., one bent to the right and the next to the left, or with the alternate and center set in which one tooth is bent to the right, the second to the left and the third straight in the center. Such separate or discrete cutting elements 44 can be secured to the bottom surface of the conditioning element 24 by various means such as, for example, by use of known bonding agents such as resins, rubber, shellac, vitrified bonds and the like, or nickel plating.

For polishing, the pressure plate carrier 18 is moved downwardly by well known mechanical means designated generally by the numeral 32. Operation of pneumatic cylinder 33 raises and lowers carrier plate 18. The pneumatic cylinder lowers the carrier 18 and adjustably forces, at a desired pressure, wafer 11 against polishing pad 13.

It is to be noted that the cutting means for conditioning the pad, be it a sharp pointed tip 30 or a relatively flat circular segment 42 carrying cutting elements 44 is not continuous but is provided with spaced cut-out portions 50 circumferentially disposed around the lower periphery. These cut-out portions 50 permit swarf and fluids to escape from the interior of the conditioning device.

In a typical operation, a substrate 11 to be polished, such as a silicon wafer held by carrier or pressure plate 18, is brought into contact with polishing pad 13 which is secured to polishing wheel 15. Preferably, to maximize polishing, an abrasive slurry is introduced between the pad and substrate. Various types of well known abrasive slurries can be used. The pressure applied to the polishing pad by carrier 18 can be selected as desired and depends upon the speed of rotation of the wheel 15 and the type of abrasive slurry used. Preferably, the wheel 15 rotates in the same direction as does the carrier plate 18 by virtue of rotation of shaft 34. Rotation of these elements is achieved by means of ordinary motors as is well known. When the carrier plate 18 is lowered so as to apply pressure on the substrate to cause it to contact the polishing pad, conditioning element 24 is also pressed down so that the downwardly depending portion carrying the cutting elements contacts the polishing pad 13. By virtue of rotation of the polishing wheel 15 and carrier plate 18, a lateral drag is asserted so that the conditioning element 24 trues and dresses the polishing pad 13 while the polishing operation is being conducted. Abrasive polishing continues in known manners until a highly planar surface is produced on the substrate.

While the drawing illustrates apparatus for polishing a single wafer, multiple wafers, such as five wafers, may be polished at a time by a multihead wafer polishing assembly operating in conjunction with a rotating polishing wheel. Such multihead wafer polishing assemblies are well known in the art, such as that, for example, disclosed in U.S. Pat. No. 5,329,732.

The present invention, which permits "in process" polishing and conditioning of polishing pads, offers numerous advantages. It is particularly advantageous for polishing operations in which a plurality of workpieces are simultaneously polished on a polishing wheel. In such multiple polishing operations the damage to polishing pads is generally greater. The invention enables greater control of the polishing pad surface profile and roughness which translates to higher removal rates and improved removal uniformity across the surface of a thin workpiece. Also, the need for aggressive pad conditioning after polishing each batch is greatly reduced and may even be eliminated. This results in improved throughput and cost reduction.

Those modifications and equivalents which fall within the spirit of the invention are to be considered a part thereof.

What is claimed is:

1. Apparatus for polishing a workpiece which comprises, in combination, a rotating polishing wheel having secured to its top surface a polishing pad, a vertically movable carrier element for carrying a workpiece to be polished into contact under pressure with said polishing pad, and a conditioning element supported by said carrier element and having on its bottom surface cutting means disposed in a circular configuration for conditioning the polishing pad by contact therewith.

2. The apparatus of claim 1 wherein the bottom surface of the conditioning element terminates in a sharp point to define the cutting means.

3. The apparatus of claim 1 wherein the conditioning element is provided with spaced cut-out portions along its lower periphery.

4. The apparatus of claim 1 wherein the cutting means are hard cutting elements secured to the bottom surface of the conditioning element.

5. The apparatus of claim 1 wherein the cutting means comprise diamond particles.

6. The apparatus of claim 1 wherein the cutting means comprise cutting teeth.

7. The apparatus of claim 1 wherein the cutting means comprise a serrated blade.

8. A method of polishing a workpiece which comprises providing a carrier element and a conditioning element, supporting the conditioning element with the carrier element, and contacting the workpiece with the carrier element so as to press the workpiece into contact with a rotating polishing wheel which is covered on its upper surface with a polishing pad, so as to effect polishing of the workpiece, and so as to condition the pad by contacting the pad with the conditioning element while polishing the workpiece.

9. A method according to claim 8, wherein an abrasive slurry is introduced between the polishing pad and workpiece during polishing.

10. A method according to claim 8, wherein the conditioning element is rotated while contacting the pad.

* * * * *